US009487353B2

(12) United States Patent
Wu

(10) Patent No.: US 9,487,353 B2
(45) Date of Patent: Nov. 8, 2016

(54) ENVIRONMENT-FRIENDLY PAPER BAG RECYCLING STORAGE PLATE

(71) Applicant: Shanghai Worth Garden Products Co., Ltd., Shanghai (CN)

(72) Inventor: Junliang Wu, Shanghai (CN)

(73) Assignee: SHANGHAI WORTH GARDEN PRODUCTS CO., LTD., Shanghai (CN)

( * ) Notice: Subject to any disclaimer, the term of this patent is extended or adjusted under 35 U.S.C. 154(b) by 91 days.

(21) Appl. No.: 14/368,367

(22) PCT Filed: Mar. 27, 2013

(86) PCT No.: PCT/CN2013/073244

§ 371 (c)(1),
(2) Date: Jun. 24, 2014

(87) PCT Pub. No.: WO2014/127553

PCT Pub. Date: Aug. 28, 2014

(65) Prior Publication Data

US 2016/0083185 A1 Mar. 24, 2016

(30) Foreign Application Priority Data

Feb. 21, 2013 (CN) ..... 2013 1 0056492

(51) Int. Cl.

| | |
|---|---|
| ***B65B 67/04*** | (2006.01) |
| ***B65F 1/14*** | (2006.01) |
| ***A47L 13/52*** | (2006.01) |

(Continued)

(52) U.S. Cl.

CPC ..... *B65F 1/1415* (2013.01); *A47L 13/52* (2013.01); *B65B 67/12* (2013.01); *B65F 1/08* (2013.01); *B65F 1/10* (2013.01); *B65F 2220/101* (2013.01);

(Continued)

(58) Field of Classification Search

USPC ..... 248/99

See application file for complete search history.

(56) References Cited

U.S. PATENT DOCUMENTS 4,064,969 A * 12/1977 Black ..... F16N 31/002 184/1.5
4,115,909 A * 9/1978 Corella ..... B65D 33/02 138/128

(Continued)

*Primary Examiner* — Monica Millner

(74) *Attorney, Agent, or Firm* — Kile Park Reed & Houtteman PLLC

(57) ABSTRACT

The invention relates to an environment-friendly paper bag recycling storage plate characterized by comprising a guide plate structure and a paper bag support plate structure which are folded by a hard foldable material. The guide plate structure is hinged with an end of the paper bag support plate structure, when in storage, the guide plate structure and the paper bag support plate structure are closely abutted and folded into a flat plate, when in use, the paper bag support plate structure and the guide plate structure are folded into a slot shape, the paper bag support plate structure is inserted into a paper bag, and a garbage housing space is formed by the slot-shaped paper bag support plate structure and the paper bag, after the guide plate structure is turned in place towards the direction away from the paper bag support plate structure, garbage enters the garbage housing space along the guide plate structure. When the environment-friendly paper bag recycling storage plate is horizontally placed to serve as a dustpan, scraps can be swept into the paper bag by a broom. The environment-friendly paper bag recycling storage plate is reusable, compact in whole structure, convenient to use, lighter than a common garbage bin, convenient to carry, foldable when not in use, small in occupied space, low in manufacturing cost, and easy to use by common people.

5 Claims, 6 Drawing Sheets

(51) Int. Cl.
*B65B 67/12* (2006.01)
*B65F 1/10* (2006.01)
*B65F 1/08* (2006.01)

(52) U.S. Cl.
CPC .... *B65F 2240/138* (2013.01); *B65F 2250/108* (2013.01)

(56) References Cited

U.S. PATENT DOCUMENTS 4,884,603 A * 12/1989 Simpson ..... B65B 67/1238 141/10
4,890,652 A * 1/1990 Hoerner ..... B65B 67/1238 141/10
5,054,724 A * 10/1991 Hutcheson ..... B65B 67/1227 220/495.11
5,129,609 A * 7/1992 Tobin ..... B65B 67/1205 141/316
5,292,093 A * 3/1994 Shumake ..... B65F 1/1415 248/152
D361,185 S * 8/1995 Seiler ..... D34/1
5,685,450 A * 11/1997 Uda ..... B65D 88/1625 220/23.9
5,716,033 A * 2/1998 Gibson ..... B65B 67/1238 248/152
5,765,614 A * 6/1998 Kardosh ..... B65F 1/10 141/316
5,897,084 A * 4/1999 Judge ..... B65B 67/1205 141/390
6,189,841 B1 * 2/2001 LaPoint ..... B65B 67/04 141/10
6,202,718 B1 * 3/2001 Innocenti ..... B65D 71/30 141/391
6,367,747 B1 * 4/2002 Mulle ..... B65D 33/007 248/97
6,415,713 B1 * 7/2002 Abrams ..... B65F 1/068 100/246
6,446,918 B1 * 9/2002 Knight ..... B65B 67/04 248/101
6,536,488 B1 * 3/2003 Pochobradsky .... B65B 67/1238 141/390
6,659,407 B2 * 12/2003 Asaro ..... B65B 67/1205 220/495.11
D507,179 S * 7/2005 King ..... D9/434
6,983,965 B1 * 1/2006 Bergell ..... B65B 67/1238 141/390
D567,464 S * 4/2008 Dullum ..... D34/6
7,815,153 B2 * 10/2010 Campbell ..... B65B 67/04 248/95
D638,189 S * 5/2011 Wolzen ..... D34/5
8,020,686 B2 * 9/2011 Babineau ..... B65F 1/10 193/2 D
8,511,895 B2 * 8/2013 Burchfield ..... B65F 1/0006 248/99
8,517,610 B2 * 8/2013 Arcot ..... B65D 31/16 141/391
8,757,563 B2 * 6/2014 Muse ..... B65B 39/007 248/97
8,840,072 B2 * 9/2014 Muse ..... B65B 67/1205 248/95
9,056,715 B2 * 6/2015 Muse ..... B65F 1/06
9,205,976 B2 * 12/2015 Clark ..... B65F 1/002
2002/0113174 A1 * 8/2002 Tomlin ..... B65F 1/1415 248/95
2004/0026578 A1 * 2/2004 King ..... B65F 1/1415 248/95
2006/0118203 A1 * 6/2006 Take ..... B65B 67/1205 141/391
2008/0029658 A1 * 2/2008 Vanbost ..... B65B 67/04 248/99
2010/0237202 A1 * 9/2010 Minicozzi ..... B65B 67/1205 248/97
2010/0243650 A1 * 9/2010 Manley ..... B65B 67/1205 220/9.4
2012/0174535 A1 * 7/2012 Copland ..... B65B 67/1205 53/473

* cited by examiner

ENVIRONMENT-FRIENDLY PAPER BAG RECYCLING STORAGE PLATE

FIELD OF THE INVENTION

The invention relates to an environment-friendly paper bag recycling storage plate.

DESCRIPTION OF THE RELATED ART

In the current world, people live in an environment filled with man-made plastic wastes, and these plastic wastes are difficult to decompose in the natural environment. In order to eliminate such environmental pollution, human beings need to use biodegradable materials to replace the most widely used plastic bags. Paper bags are ideal alternatives, but it is also inconvenient to use paper bags, for example, the bag mouth is easily torn, it is difficult to place paper bags, it is difficult to fully open paper bags to use their capacity, and angular materials easily puncture paper bags, thus the use of paper bags is limited.

U.S. design Pat. D513352S discloses a hard tank. The hard tank is inserted into a paper bag to support the paper bag, which can partially solve the problems. The tank then has the following problems: 1. when the hard tank is unused, a certain space will be occupied as a guide plate is irreversible, thus it is inconvenient to store; 2. notch of the storage plate is larger than ⅔, thus the storage plate is easily broken, and inconvenient to carry or store; 3. the whole plate is unstable after formation, and it is inconvenient to insert into the paper bag, and 4. when the paper bag is placed horizontally to serve as a dustpan, the guide plate can not rotate for folded paper, thus things can not be easily swept into the low box by a broom.

SUMMARY OF THE INVENTION

The objective of the invention is to provide a convenient storage and low cost device which can make full use of a paper bag.

In order to achieve the objective, the technical solution of the invention is to provide an environment-friendly paper bag recycling storage plate characterized by comprising a guide plate structure and a paper bag support plate structure which are folded by a hard foldable material. The guide plate structure is hinged with an end of the paper bag support plate structure, when in storage, the guide plate structure and the paper bag support plate structure are closely abutted and folded into a flat plate, when in use, the paper bag support plate structure and the guide plate structure are folded into a slot shape, the paper bag support plate structure is inserted into a paper bag, and a garbage housing space is formed by the slot-shaped paper bag support plate structure and the paper bag, then garbage enters the garbage housing space along the guide plate structure.

Preferably, the guide plate structure comprises a guide plate, a first fold line parallel to a second fold line is formed at the middle part of the guide plate, when in storage, a left part and a right part of the guide plate fold inwards along the first fold line and the second fold line respectively to fold the guide plate into a flat plate, when in use, the left part and the right part of the guide plate fold outwards along the first fold line and the second fold line respectively to fold the guide plate into a slot shape.

Preferably, the paper bag support plate structure comprises a paper bag support plate, a third fold line parallel to a fourth fold line is formed at the middle part of the paper bag support plate, the distance between the third fold line and the fourth fold line is narrower than that between the first fold line and the second fold line, when in storage, a left part and a right part of the paper bag support plate fold inwards along the third fold line and the fourth fold line respectively to fold the paper bag support plate into a flat plate, when in use, the left part and the right part of the paper bag support plate fold outwards along the third fold line and the fourth fold line respectively to fold the paper bag support plate into a slot shape.

Preferably, a first pin hole is arranged at the left end and the right end of the guide plate respectively, and a second pin hole is arranged at the left part and the right part of the paper bag support plate, a pin passes through the first pin hole and the second pin hole and hinges the guide plate structure with the paper bag support plate structure, and then the pin is fixed by a pin cover.

Preferably, one edge of the guide plate between the first fold line and the second fold line extends outward to form an extension portion, the extension portion folds along a fifth fold line, the guide plate structure in turning keeps off the paper bag support plate structure via the folded extension portion, so that the guide plate structure is turned in place smoothly, slot walls at both sides of the paper bag support plate structure are respectively snapped into a corner formed by the edge at the extension portion side and the left edge or the right edge of the guide plate at respective side, and garbage sliding automatically through the guide plate structure is buffered by outward folding of the extension portion.

Preferably, at least two finger insertion holes are respectively arranged at the left part and the right part of the guide plate.

Preferably, the hard material is cardboard or corrugated paper.

The environment-friendly paper bag recycling storage plate comprises a guide plate structure and a paper bag support plate structure, the guide plate structure and the paper bag support plate structure are linked by a pin and a pin cover, and rotate to form a rectangle, then the rectangle is inserted into a paper bag to form a storage box or garbage bin in vertical placement, or a dustpan in horizontal placement. When the paper bag is full, fingers can penetrate four holes on the paper bag support plate to pull the storage plate out of the paper bag. The storage plate is reusable, compact in whole structure, convenient to use, lighter than a common garbage bin, convenient to carry, foldable when not in use, small in occupied space, low in manufacturing cost, and easy to use by common people.

DESCRIPTION OF THE PREFERRED EMBODIMENT

The invention is described in detail in combination with the following drawings and preferred embodiments for clear understanding.

Figure 1:
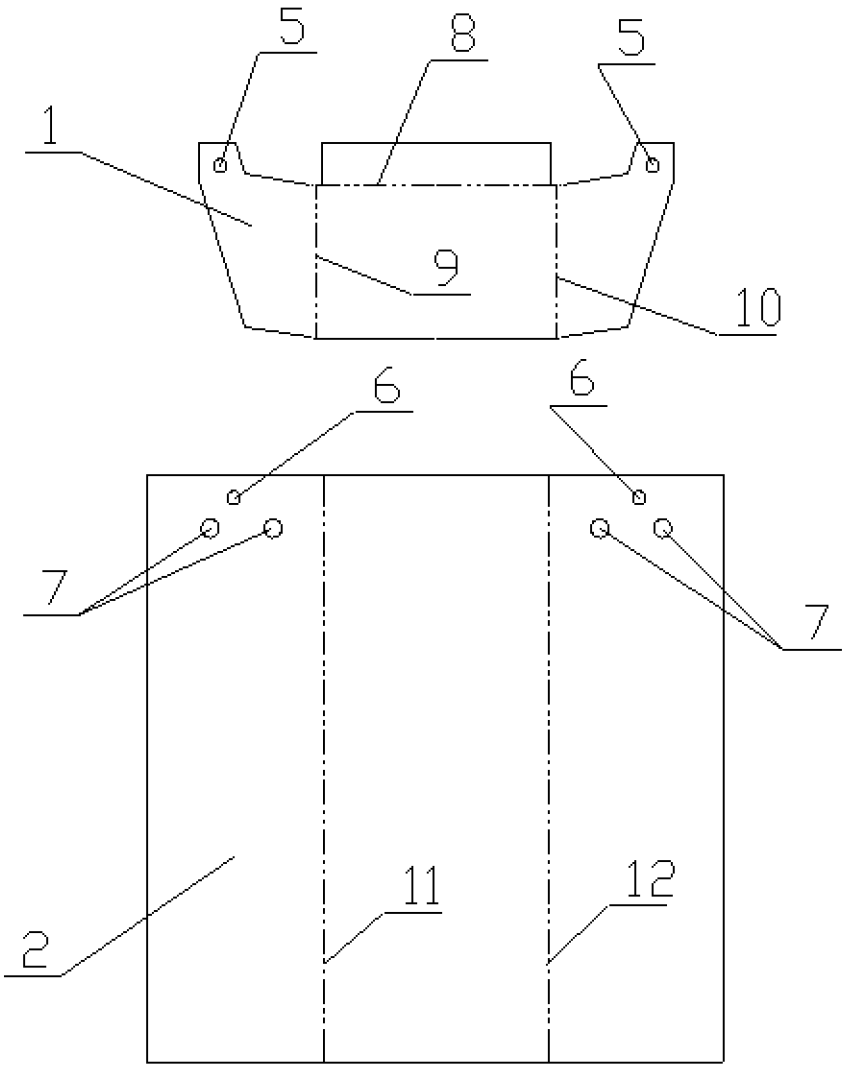
FIG. 1 is a schematic diagram of an unfolded environment-friendly paper bag recycling storage plate provided by the invention.
Figure 2:
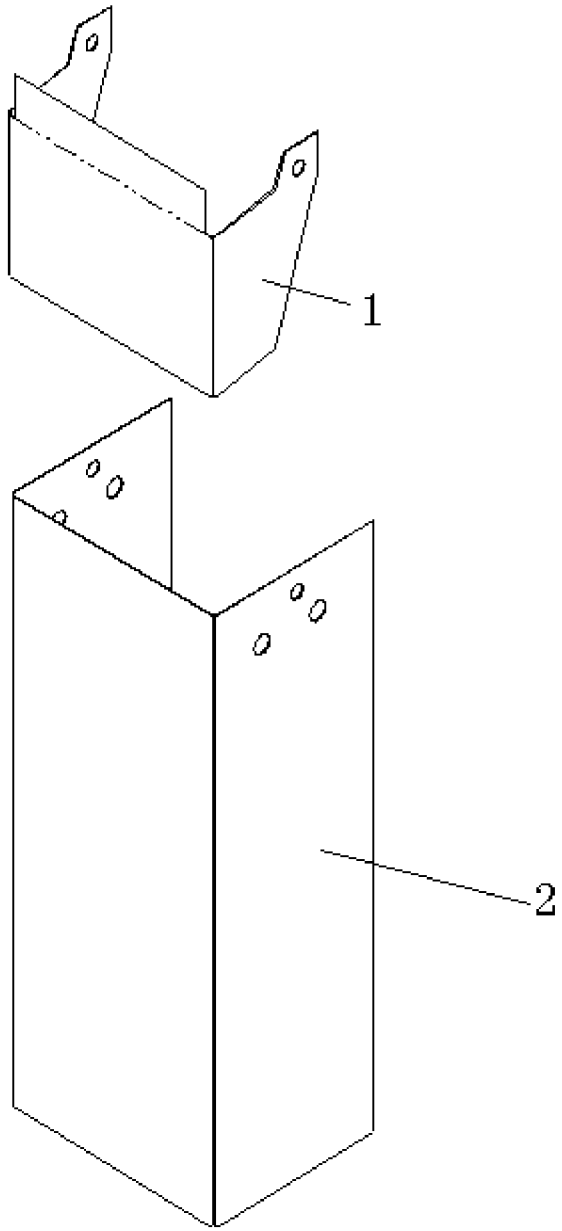
FIG. 2 is a diagram of a folded environment-friendly paper bag recycling storage plate provided by the invention.
Figure 3:
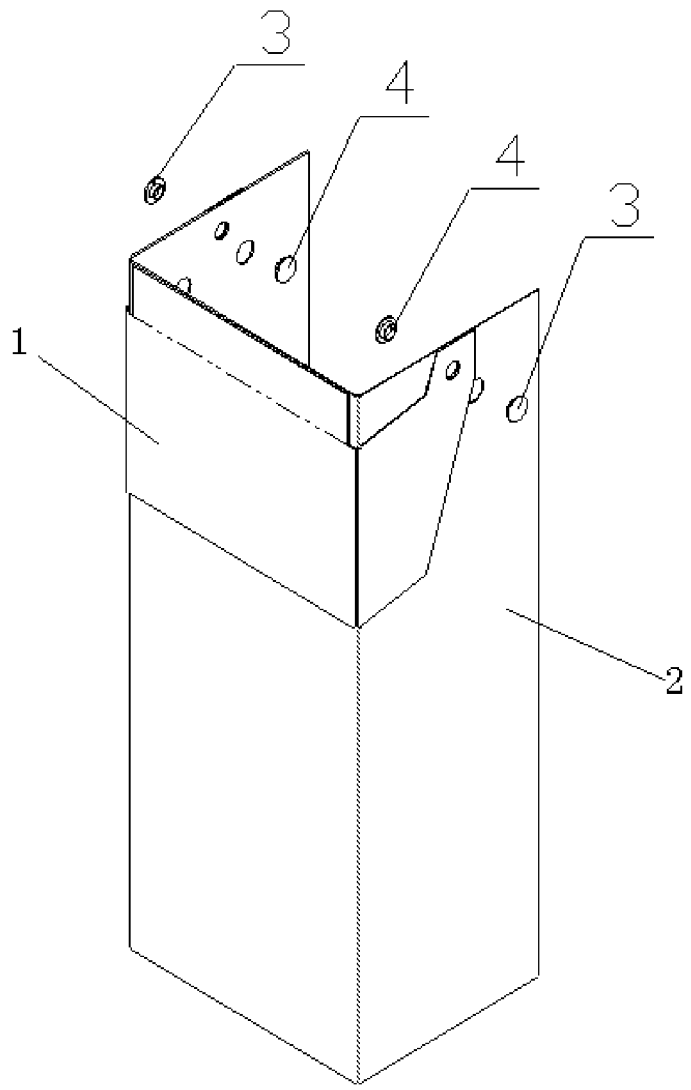
FIG. 3 is an assembly drawing of an environment-friendly paper bag recycling storage plate provided by the invention.
Figure 4:
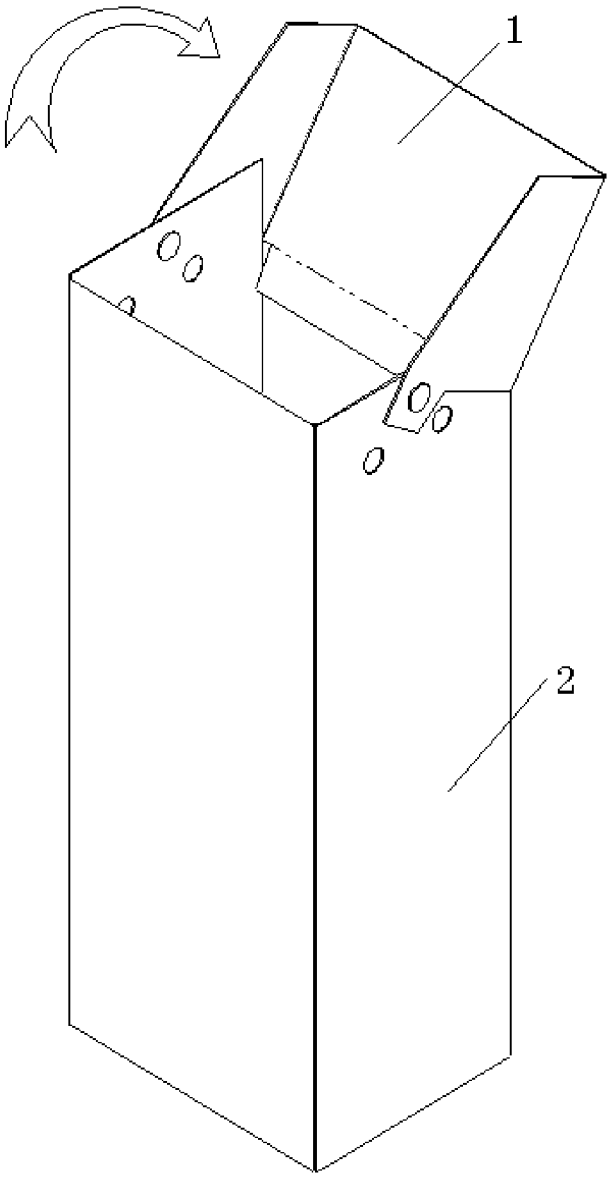
FIG. 4 is a diagram of the use state of an environment-friendly paper bag recycling storage plate provided by the invention.

As shown in FIG. 1, an environment-friendly paper bag recycling storage plate provided by the invention comprises a guide plate structure 1 and a paper bag support plate structure 2 which are folded by a hard foldable material. The hard material can be of cardboard or corrugated paper. The guide plate structure 1 and the paper bag support plate structure 2 comprise a guide plate and a paper bag support plate respectively, a first fold line 9 parallel to a second fold line 10 is formed at the middle part of the guide plate, and a slightly narrow third fold line 11 parallel to a slightly narrow fourth fold line 12 is formed at a corresponding position of the paper bag support plate. One edge of the guide plate between the first fold line 9 and the second fold line 10 extends outward to form an extension portion, and the extension portion can fold along a fifth fold line 8. A first pin hole 5 is arranged at the left end and the right end of the guide plate respectively, and a second pin hole 6 is arranged at corresponding position of the left part and the right part of the paper bag support plate. Two finger insertion holes 7 are respectively arranged at the left part and the right part below the second pin hole 6 of the paper bag support plate. According to FIG. 2 to FIG. 4, when in use, the left part and the right part of the guide plate fold outwards along the first fold line 9 and the second fold line 10 respectively to fold the guide plate into a slot shape, and the left part and the right part of the paper bag support plate fold outwards along the third fold line 11 and the fourth fold line 12 respectively to fold the paper bag support plate into a slot shape. A pin 3 passes through the first pin hole 5 and the second pin hole 6 and hinges the guide plate structure 1 with the paper bag support plate structure 2, and then the pin 3 is fixed by a pin cover 4. The guide plate structure 1 is turned towards the direction away from the paper bag support plate structure 2, the guide plate structure 1 in turning keeps off the paper bag support plate structure 2 via the folded extension portion, so that the guide plate structure 1 is turned in place smoothly, after turning in place, the paper bag support plate structure 2 is in a stable state. Slot walls at both sides of the paper bag support plate structure 2 are respectively snapped into a corner formed by the edge at the extension portion side and the left edge or the right edge of the guide plate at respective side, and garbage sliding automatically through the guide plate structure 1 is buffered by outward folding of the extension portion.

Figure 5:
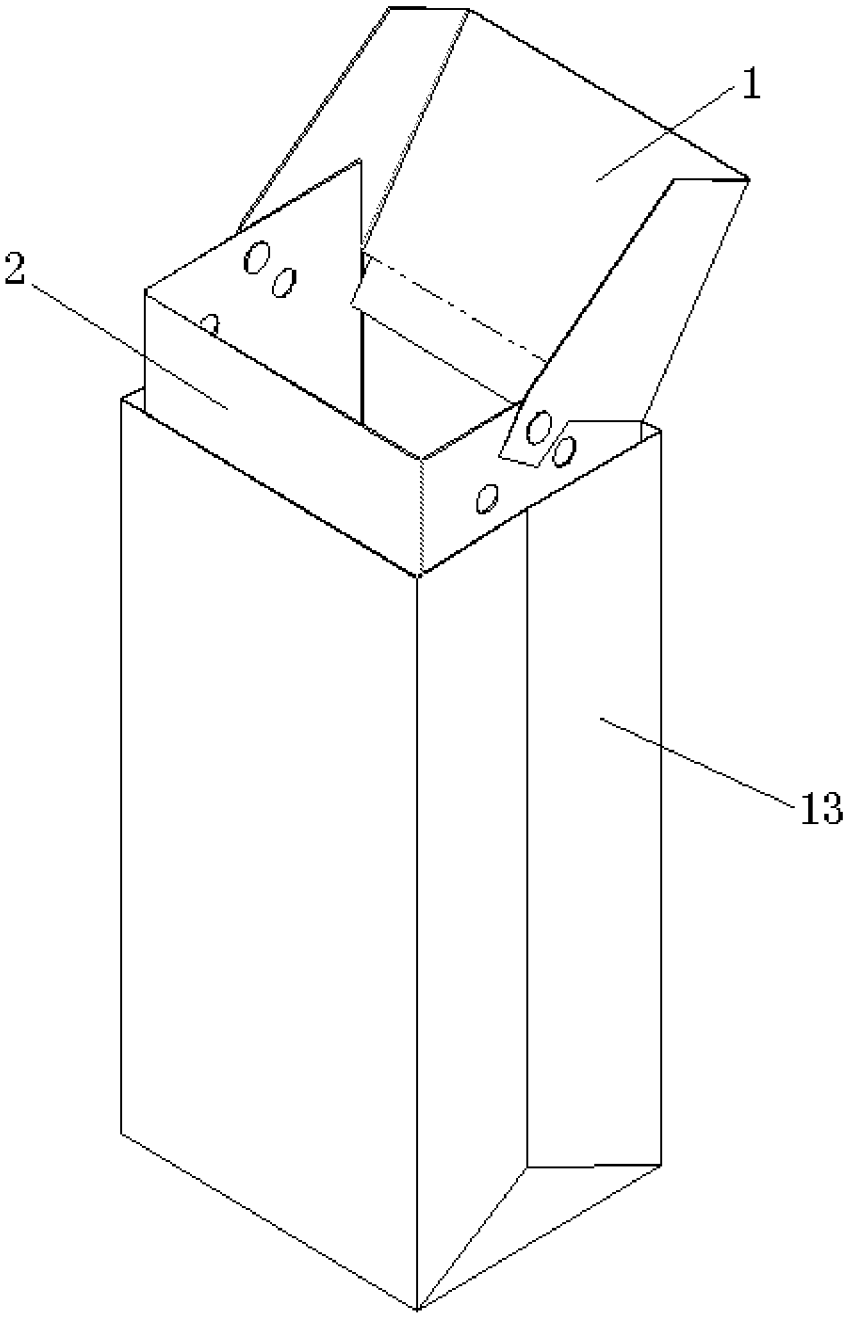
FIG. 5 is a diagram of a vertical storage box in which a paper bag and an environment-friendly paper bag recycling storage plate provided by the invention are used together.
Figure 6:
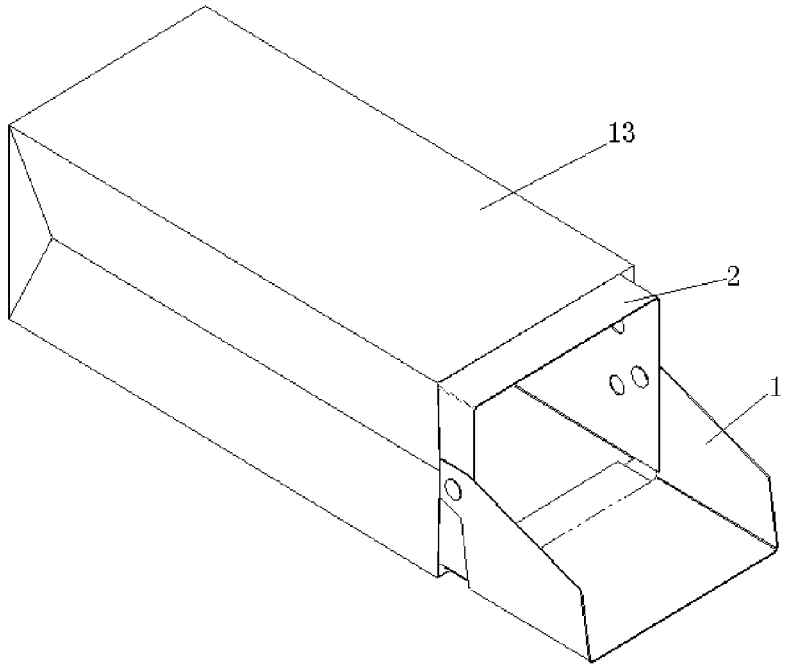
FIG. 6 is a diagram of a horizontal storage box in which a paper bag and an environment-friendly paper bag recycling storage plate provided by the invention are used together.

An environment-friendly paper bag recycling storage plate provided by the invention can be vertically inserted in a paper bag 13 to form a vertical storage box as shown in FIG. 5, or horizontally inserted into the paper bag 13 to form a horizontal storage box as shown in FIG. 6, thus a broom can be used for easily sweeping scraps into the storage box.

Figure 7A:
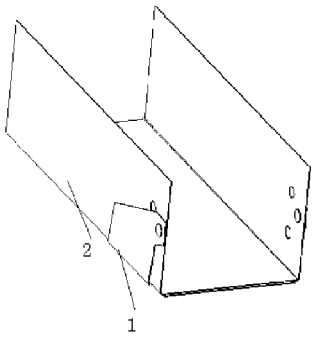
FIG. 7A is a diagram of the initial storage state of an environment-friendly paper bag recycling storage plate provided by the invention.
Figure 7B:
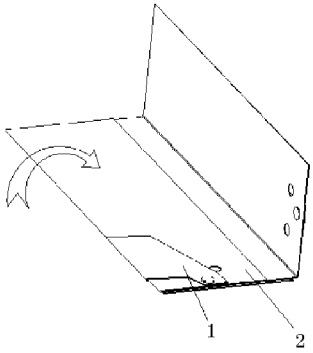
FIG. 7B is a diagram of the intermediate storage state of an environment-friendly paper bag recycling storage plate provided by the invention.
Figure 7C:
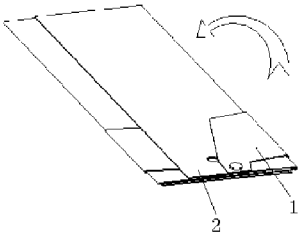
FIG. 7C is a diagram of the final storage state of an environment-friendly paper bag recycling storage plate provided by the invention.

According to FIG. 7A to FIG. 7C, when in storage, the guide plate structure 1 can be turned inward to closely abut the guide plate structure 1 with the paper bag support plate structure 2, then the paper bag support plate and the guide plate are folded inward along corresponding fold lines into flat plates, thus the environment-friendly paper bag recycling storage plate can be easily carried, stored and transported.

What is claimed is:

1. An environment-friendly paper bag recycling storage plate, characterized by comprising a guide plate structure (1) and a paper bag support plate structure (2) which are folded by a hard foldable material, wherein the guide plate structure (1) is hinged with an end of the paper bag support plate structure (2), when in storage, the guide plate structure (1) and the paper bag support plate structure (2) are closely abutted and folded into a flat plate, when in use, the paper bag support plate structure (2) and the guide plate structure (1) are folded into a slot shape, the paper bag support plate structure (2) is inserted into a paper bag (13), and a garbage housing space is formed by the slot-shaped paper bag support plate structure (2) and the paper bag (13), then garbage enters the garbage housing space along the guide plate structure (1);

wherein the guide plate structure (1) comprises a guide plate, a first fold line (9) parallel to a second fold line (10) formed at the middle part of the guide plate, when in storage, a left part and a right part of the guide plate fold inwards along the first fold line (9) and the second fold line (10) respectively to fold the guide plate into a flat plate, when in use, the left part and the right part of the guide plate fold outwards along the first fold line (9) and the second fold line (10) respectively to fold the guide plate into a slot shape; and wherein the paper bag support plate structure (2) comprises a paper bag support plate, a third fold line (11) parallel to a fourth fold line (12) formed at the middle part of the paper bag support plate, the distance between the third fold line (11) and the fourth fold line (12) is narrower than that between the first fold line (9) and the second fold line (10), when in storage, a left part and a right part of the paper bag support plate fold inwards along the third fold line (11) and the fourth fold line (12) respectively to fold the paper bag support plate into a flat plate, when in use, the left part and the right part of the paper bag support plate fold outwards along the third fold line (11) and the fourth fold line (12) respectively to fold the paper bag support plate into a slot shape.

2. The environment-friendly paper bag recycling storage plate of claim 1, characterized in that a first pin hole (5) is arranged at the left end and the right end of the guide plate respectively, and a second pin hole (6) is arranged at the left part and the right part of the paper bag support plate, a pin (3) passes through the first pin hole (5) and the second pin hole (6) and hinges the guide plate structure (1) with the paper bag support plate structure (2), and then the pin (3) is fixed by a pin cover (4).

3. The environment-friendly paper bag recycling storage plate of claim 1, characterized in that one edge of the guide plate between the first fold line (9) and the second fold line (10) extends outward to form an extension portion, the extension portion folds along a fifth fold line (8), the guide plate structure (1) in turning keeps off the paper bag support plate structure (2) via the folded extension portion, so that the guide plate structure (1) is turned in place smoothly, slot walls at both sides of the paper bag support plate structure (2) are respectively snapped into a corner formed by the edge at the extension portion side and the left edge or the right edge of the guide plate at respective side, and garbage sliding automatically through the guide plate structure (1) is buffered by outward folding of the extension portion.

4. The environment-friendly paper bag recycling storage plate of claim 1, characterized in that at least two finger insertion holes (7) are respectively arranged at the left part and the right part of the paper bag support plate structure (2).

5. The environment-friendly paper bag recycling storage plate of claim 1, characterized in that the hard material is cardboard or corrugated paper.

* * * * *